US006096470A

United States Patent [19]

Fuller et al.

[11] Patent Number: 6,096,470

[45] Date of Patent: Aug. 1, 2000

[54] ELECTROPHOTOGRAPHIC IMAGING MEMBER OVERCOAT FABRICATION PROCESS

[75] Inventors: Timothy J. Fuller, Pittsford; Damodar M. Pai, Fairport; John F. Yanus, Webster; Anthony T. Ward, Webster; Harold F. Hammond, Webster; Merlin E. Scharfe, Penfield; Paul J. DeFeo, Sodus Point, all of N.Y.

[73] Assignee: Xerox Corporation, Stamford, Conn.

[21] Appl. No.: 09/429,378

[22] Filed: Oct. 28, 1999

[51] Int. Cl.[7] ..... G03G 5/047; G03G 5/147

[52] U.S. Cl. ..... 430/132

[58] Field of Search ..... 430/132

[56] References Cited

U.S. PATENT DOCUMENTS

| | | | |
|---|---|---|---|
| 4,426,435 | 1/1984 | Oka | 430/132 |
| 4,515,882 | 5/1985 | Mammino et al. | 430/66 |
| 5,213,937 | 5/1993 | Miyake | 430/130 |
| 5,368,967 | 11/1994 | Schank et al. | 430/58.3 |
| 5,391,447 | 2/1995 | Pai et al. | 430/132 |
| 5,476,740 | 12/1995 | Markovics et al. | 430/57.3 |
| 5,518,853 | 5/1996 | Nguyen et al. | 430/132 |
| 5,521,047 | 5/1996 | Yuh et al. | 430/132 |
| 5,681,679 | 10/1997 | Schank et al. | 430/58.2 |
| 5,702,854 | 12/1997 | Schank et al. | 430/58.7 |
| 5,709,974 | 1/1998 | Yuh et al. | 430/58.6 |

FOREIGN PATENT DOCUMENTS

| | | | |
|---|---|---|---|
| 5-72749 | 3/1993 | Japan | 430/132 |

*Primary Examiner*—Roland Martin

[57] ABSTRACT

A process for fabricating an electrophotographic imaging member including forming a charge generating layer, forming an undried charge transport layer coating by applying to the charge generating layer a solution selected from either or both the group consisting of a solution including a charge transport molecule, a first film forming binder and at least a first solvent and a solution including a charge transporting polymer and at least a first solvent, forming an undried overcoat layer coating by applying to the undried charge transport layer coating an overcoat layer coating solution including a second film forming polymer and at least a second solvent, the charge transport molecule and first film forming polymer or either or both a charge transporting polymer being substantially insoluble in the second solvent and the second polymer being substantially insoluble in the first solvent, applying heat to both the undried charge transport layer coating and the undried overcoat layer coating to migrate the first solvent from the charge transport layer coating through the undried overcoat layer coating while maintaining the overcoat layer coating porous to migration of the first solvent through the overcoat layer coating until the charge transport layer is substantially dry, increasing the heat applied to the overcoat layer coating to form a substantially dry overcoat layer.

19 Claims, No Drawings

ELECTROPHOTOGRAPHIC IMAGING MEMBER OVERCOAT FABRICATION PROCESS

BACKGROUND OF THE INVENTION

This invention relates to electrophotography and more particularly, to an improved method of fabricating an overcoated electrophotographic imaging member.

Generally, electrophotographic imaging processes involve the formation and development of electrostatic latent images on the imaging surface of a photoconductive member. The photoconductive member is usually imaged by uniformly electrostatically charging the imaging surface in the dark and exposing the member to a pattern of activating electromagnetic radiation such as light, to selectively dissipate the charge in the illuminated areas of the member to form an electrostatic latent image on the imaging surface. The electrostatic latent image is then developed with a developer composition containing toner particles which are attracted to the photoconductive member in image configuration. The resulting toner image is often transferred to a suitable receiving member such as paper.

The photoconductive members include single or multiple layered devices comprising homogeneous or heterogeneous inorganic or organic compositions and the like. One example of a photoconductive member containing a heterogeneous composition is described in U.S. Pat. No. 3,121,006 wherein finely divided particles of a photoconductive inorganic compound is dispersed in an electrically insulating organic resin binder. The commercial embodiment usually comprises a paper backing containing a coating thereon of a binder layer comprising particles of zinc oxide uniformly dispersed therein. Useful binder materials disclosed therein include those which are incapable of transporting for any significant distance injected charge carriers generated by the photoconductive particles. Thus, the photoconductive particles must be in substantially contiguous particle to particle contact throughout the layer for the purpose of permitting charge dissipation required for cyclic operation. Thus, about 50 percent by volume of photoconductive particles is usually necessary in order to obtain sufficient photoconductive particle to particle contact for rapid discharge. These relatively high photoconductive concentrations can adversely affect the physical continuity of the resin binder and can significantly reduce the mechanical strength of the binder layer.

Other known photoconductive compositions include amorphous selenium, halogen doped amorphous selenium, amorphous selenium alloys including selenium arsenic, selenium tellurium, selenium arsenic antimony, halogen doped selenium alloys, cadmium sulfide and the like. Generally, these inorganic photoconductive materials are deposited as a relatively homogeneous layer on suitable conductive substrates. Some of these inorganic layers tend to crystallize when exposed to certain vapors that may occasionally be found in the ambient atmosphere. Moreover, the surfaces of selenium type photoreceptors are highly susceptible to scratches which print out in final copies.

Still other electrophotographic imaging members known in the art comprise a conductive substrate having deposited thereon an organic photoconductor such as a polyvinylcarbazole-2,4,7-trinitrofluorenone combination, phthalocyanines, quinacridones, pyrazolones and the like. Some of these photoreceptors, such as those containing 2,4,7-trinitrofluorenone, present health or safety issues.

Recently, there has been disclosed layered photoresponsive devices comprising photogenerating layers and transport layers deposited on conductive substrates as described, for example, in U.S. Pat. No. 4,265,990 and overcoated photoresponsive materials containing a hole injecting layer, a hole transport layer, a photogenerating layer and a top coating of an insulating organic resin, as described, for example, in U.S. Pat. No. 4,251,612. Examples of photogenerating layers disclosed in these patents include trigonal selenium and various phthalocyanines and hole transport layers containing certain diamines dispersed in inactive polycarbonate resin materials. The disclosures of each of these patents, namely, U.S. Pat. No. 4,265,990 and U.S. Pat. No. 4,251,612 are incorporated herein by reference in their entirety. Other representative patents containing layered photoresponsive devices include U.S. Pat. No. 3,041,116; U.S. Pat. No. 4,115,116; U.S. Pat. No. 4,047,949 and U.S. Pat. No. 4,081,274. These patents relate to systems that require negative charging for hole transporting layers when the photogenerating layer is beneath the transport layer. Photogenerating layers overlying hole transport layers require positive charging but must be equal to or less than about 1 to 2 micrometers for adequate sensitivity and therefore wear away quite rapidly.

While the above described electrophotographic imaging members may be suitable for their intended purposes, there continues to be a need for improved devices. For example, the imaging surface of many photoconductive members is sensitive to wear, ambient fumes, scratches and deposits which adversely affect the electrophotographic properties of the imaging member.

Also, in multilayered photoreceptors comprising a charge generating layer and a charge transport layer, wear of the transport layer during image cycling limits the life of small diameter organic photoreceptor drums employed in copiers, duplicators, printers, facsimile machines and the like. With the advent of Bias Charging Rolls (BCR),and Bias Transfer Rolls (BTR) the drum wear is catastrophic. Even with the gentlest of the Bias Charging Rolls, the wear is as much as 8 to 10 micrometers in 100 kilocycles of revolutions. With the small diameter drum and duty cycle considerations 100 kilocycles of revolution translates to as little as 10,000 to 20,000 prints. The machines employing these small diameter drums do not employ exposure control. Wear results in considerable reduction of sensitivity of the device. A drum life of 50,000 or more prints (one or million drum revolution cycles) is sorely needed.

Overcoating layers have been proposed to overcome the undesirable characteristics of uncoated photoreceptors. However, many of the overcoating layers adversely affect electrophotographic performance of an electrophotographic imaging member. Moreover, the application of an overcoat requires an additional coating and drying step which increases the number of processing steps and increases fabrication costs. One way of reducing cost (of plant as well as manufacturing process), would be to skip the transport layer drying step. In this scheme, after the transport layer is coated (by dip or other processes), the overcoat is coated and then both transport layer and overcoat are dried in one step to increase throughput. However, in the one step drying process, the overcoat can harden before the transport layer solvent is adequately removed and high residual solvent content in the generator and transport layers severely affects the shape of the photoinduced discharge curve (PIDC) during imaging. Moreover, application of an overcoat composition that transports holes (without trapping), is insensitive to moisture, has a low wear rate and can be applied without redissolving the transport layer is not a simple task. While some of the above-described imaging members exhibit certain desirable properties such as protecting the surface of an underlying photoconductive layer, there continues to be a need for improved overcoating layers for protecting electrophotographic imaging members.

INFORMATION DISCLOSURE STATEMENT

U.S. Pat. No. 5,476,740 to Markovics, et al., issued Dec. 19, 1995—An electrophotographic imaging member is disclosed which includes a charge generating layer, a charge transport layer and an interphase region. The interphase region includes a mixture of a charge generating material and a charge transport material, in intimate contact, and may be formed, for example, by applying a charge transport material prior to drying or curing an underlying charge generating layer to produce an interphase structure that is different from the charge generating and charge transport layers.

U.S. Pat. No. 5,213,937 to Miyake, issued May 25, 1993—A process of preparing electrophotographic photoreceptor aluminum drums is disclosed having coated layers with a constant thickness and properties is disclosed. After a carrier generation layer being dip coated, a process of conveyance is followed at a temperature same as that of the coating material.

U.S. Pat. No. 4,515,882 issued to Mamino et al. on May 7, 1985.—An electrophotographic imaging system is disclosed utilizing a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

U.S. Pat. No. 5,702,854 issued to Schank et al. on Dec. 30, 1997—An electrophotographic imaging member is disclosed including a supporting substrate coated with at least a charge generating layer, a charge transport layer and an overcoating layer, said overcoating layer comprising a dihydroxy arylamine dissolved or molecularly dispersed in a cross linked polyamide matrix. The overcoating layer is formed by cross linking a cross linkable coating composition including a polyamide containing methoxy methyl groups attached to amide nitrogen atoms, a cross linking catalyst and a dihydroxy amine, and heating the coating to cross link the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,368,967 issued to Schank et al. on Nov. 29, 1994—An electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups of the hydroxy arylamine and hydroxy or multihydroxy triphenyl methane. This overcoat layer may be fabricated using an alcohol solvent. This electrophotographic imaging member may be utilized in an electrophotographic imaging process.

U.S. Pat. No. 5709,974 issued to Yuh et al. on Jan. 20, 1998—An electrophotographic imaging member is disclosed including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5681679 issued to Schank et al on Oct. 28, 1997—A flexible electrophotographic imaging member is disclosed including a supporting substrate and a resilient combination of at least one photoconductive layer and an overcoating layer, at least one photoconductive layer comprising a hole transporting arylamine siloxane polymer and the overcoating comprising a cross linked polyamide doped with a dihydroxy amine. This imaging member may be utilized in an imaging process including the formation of an electrostatic latent image on the imaging member, depositing toner particles on the imaging member in conformance with the latent image to form a toner image, and transferring the toner image to a receiving member.

U.S. Pat. No. 4,426,435 issued to Oka on Jan. 17, 1984—An electrophotographic light-sensitive member is disclosed comprising a conductive support, a photoconductive layer and a protective outer layer, the protective outer layer comprising at least one particulate metal oxide having a mean particle size below about 0.3 um dispersed in an organic resin binder material. The electrophotographic light-sensitive member may be prepared by initially forming the protective outer layer and thereafter applying the photoconductive layer and conductive support thereto.

CROSS REFERENCE TO COPENDING APPLICATIONS

U.S. Application Ser. No. 09/408,239 entitled PROCESS FOR PREPARING ELECTROPHOTOGRAPHIC IMAGING MEMBER, filed in the names of K. Evans et al. on Sep. 29, 1999 (Attorney Docket No. D/99617), now U.S. Pat. No. 6,048,658, —A process for fabricating electrophotographic imaging members comprising providing a substrate with an exposed surface, simultaneously applying, from a coating die, two wet coatings to the surface, the wet coatings comprising a first coating in contact with the surface, the first coating comprising photoconductive particles dispersed in a solution of a film forming binder and a predetermined amount of solvent for the binder and a second coating in contact with the first coating, the second coating comprising a solution of a charge transporting small molecule and a film forming binder dissolved in a predetermined amount of solvent for the transport molecule and the binder, drying the two wet coatings to remove substantially all of the solvents to form a dry first coating having a thickness between about 0.1 micrometer and about 10 micrometers and dry second coating having a thickness between about 4 micrometers and 20 micrometers, applying at least a third coating in contact with the second coating, the third coating comprising a solution containing having a charge transporting small molecule, film forming binder and solvent substantially identical to charge transporting small molecule, film forming binder and solvent in the second coating, and drying the third coating to from a dry third coating having a thickness between about 13 micrometers and 20 micrometers.

U.S. Application Ser. No. 09/429,387 pending entitled IMAGING MEMBER WITH PARTIALLY CONDUCTIVE OVERCOATING, filed in the names of Fuller et al. concurrently herewith (Attorney Docket No. D99403)—An electrophotographic imaging member including at least one photographic imaging layer and a partially electrically conductive overcoat layer including finely divided charge injection enabling particles dispersed in a charge transporting continuous matrix including a cross linked polyamide, charge transport molecules and oxidized charge transport molecules, the continuous matrix being formed from a solution selected from the group including a first solution including cross linkable alcohol soluble polyamide containing methoxy methyl groups attached to amide nitrogen atoms, an acid having a $pK_a$ of less than about 3, a cross linking agent selected from the group comprising a formaldehyde generating cross linking agent, an alkoxylated cross linking agent, an methylolamine cross linking agent and mixtures thereof, a dihydroxy arylamine, and a liquid selected from the group including alcohol solvents, diluent and mixtures thereof, a second solution including crosslinkable alcohol soluble polyamide free of methoxy methyl groups attached to amide nitrogen atoms, an acid having a $pK_a$ of less than about 3, an alkoxylated cross linking agent, an methylolamine cross linking agent and mixtures thereof, a dihydroxy arylamine, and a liquid selected from the group including alcohol solvents, diluent and mixtures thereof.

The electrophotographic imaging process is also disclosed. The entire disclosure of the application is incorporated herein by reference.

U.S. Application Ser. No. 09/218409 pending entitled Novel Cross Linked Conducting Compositions, filed in the names of T. Fuller et al. on Dec. 22, 1998 (Attorney Docket No. D97377)—Described is a conductive composition including a mixture of a reaction product of a hole transporting hydroxy functionalized aryl amine, a hydroxy functionalized arylamine that is different from the hole transporting hydroxy functionalized aryl amine, a cross linkable polyamide, and an acid capable of simultaneously cross linking the polyamide and oxidizing a portion of the hydroxy functionalized arylamine, the mixture of a reaction product including a hole transporting hydroxy functionalized aryl amine and an oxidized hydroxy functionalized aryl amine in a crosslinked polyamide matrix. Other embodiments including processes for applying the aforementioned composition and processes for using devices containing the compositions in high speed laser printing and related printing systems are also disclosed. The entire disclosure of the application is incorporated herein by reference.

BRIEF SUMMARY OF THE INVENTION

It is, therefore, an object of the present invention to provide an improved electrophotographic imaging member which overcomes the above-noted deficiencies.

It is another object of the present invention to provide an improved electrophotographic imaging member which exhibits longer wear life.

It is still another object of the present invention to provide thicker overcoats without the Photo-induced Discharge Characteristics (PIDC) being adversely affected by mobility limitations in the overcoat layer.

It is yet another object of the present invention to provide thicker overcoats without significant light attenuation in the overcoat.

It is another object of the present invention to provide thicker overcoats where the charge carriers causing conductivity emanate from two different sources.

It is still another object of the present invention to provide thicker overcoats on undried charge transport layers.

It yet another object of the present invention to provide thicker overcoats on undried charge transport layers followed by drying of the charge transport layer prior to completion of drying of the overcoats.

The foregoing objects and others are accomplished in accordance with this invention by providing a process for fabricating an electrophotographic imaging member comprising forming a charge generating layer, forming an undried charge transport layer coating by applying to the charge generating layer a solution selected from either or both the group consisting of a solution comprising a charge transport molecule, a first film forming binder and at least a first solvent and/or a solution comprising a charge transporting polymer and at least a first solvent, forming an undried overcoat layer coating by applying to the undried charge transport layer coating an overcoat layer coating solution comprising a second film forming polymer and at least a second solvent, the charge transport molecule and first film forming polymer or with either or in combination with a charge transporting polymer being substantially insoluble in the second solvent and the second polymer being substantially insoluble in the first solvent, applying heat to both the undried charge transport layer coating and the undried overcoat layer coating to migrate the first solvent from the charge transport layer coating through the undried overcoat layer coating while maintaining the overcoat layer coating porous to migration of the first solvent through the overcoat layer coating until the charge transport layer is substantially dry, increasing the heat applied to the overcoat layer coating to form a substantially dry overcoat layer.

Electrophotographic imaging members are well known in the art. Electrophotographic imaging members may be prepared by any suitable technique. to Typically, a flexible or rigid substrate is provided with an electrically conductive surface. A it charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise any suitable charge transporting small molecule dissolved or molecularly dispersed in any suitable film forming electrically inert polymer. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylaminostyryl)-S-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methyl phenyl)-(1,1'-biphenyl)-4,4'-diamine.

Any suitable electrically inert solvent soluble polymeric binder may be used to disperse the electrically active molecule in the charge transport layer. Polycarbonate film forming polymers are preferred and include, for example, poly(4,4'-isopropylidene-di phenylene)carbonate (also referred to as bisphenol-A-polycarbonate), poly(4,4'-isopropylidene-diphenylene)carbonate, poly(4,4'-diphenyl-1/1'-cyclohexane carbonate), and the like. Other typical inactive resin binders include polyester, polyarylate, polyacrylate, polyether, polysulfone, and the like. Weight average molecular weights can vary, for example, from about 20,000 to about 150,000.

Instead of a small molecule charge transporting compound dissolved or molecularly dispersed in an electrically inert polymeric binder, the charge transport layer may comprise any suitable charge transporting polymer. Typical charge transporting polymers are ones obtained from the condensation of N,N'-diphenyl-N,N'-bis(3-hydroxyphenyl)-(1,1'-biphenyl)-4,4'-diamine and diethylene glycol bischloroformate such as disclosed in U.S. Pat. No. 4,806,443 and U.S. Pat. No. 5,028,687, the entire disclosures of these patent being incorporated herein by reference. Another typical charge transporting polymer is poly[(N,N'-bis-3-oxyphenyl)-N,N'-diphenyl-(1,1'-biphenyl)-(4,4'-diamine)-co-sebacoyl}polyester obtained from the condensation of N,N'-diphenyl-N,N'-bis(3-hydroxy phenyl)-1,1'-biphenyl-4,4'-diamine and sebacoyl chloride.

Any suitable ratio of solids to solution may be employed for applying the charge transport layer coating. The specific ratio selected will depend on numerous factors, including, for example, the specific materials selected, the type of coating technique employed, and the time period between deposition of the transport layer and the deposition of the overcoat layer. Satisfactory results may be obtained with a charge transport layer coating solution containing between about 5 percent by weight solids and 30 percent by weight solids and between about 95 percent by weight and about 70 percent by weight solvent, based on the total weight of the solution. Preferably, the charge transport layer solution contains between about 15 and 20 percent by weight solids and between about 85 and 80 percent by weight solvent, based on the total weight of the solution. Any suitable solvent which evaporates at a temperature below temperatures which adversely affect the physical and electrical properties of the photoreceptor may be utilized. The solvent utilized should not dissolve the film forming binder of the overcoat layer and should dissolve the film forming binder selected for the charge transport layer. The solvent may comprise any suitable rapid evaporating or slow evaporating solvent or solvent combinations thereof.—Typical rapid evaporating solvents are methylene chloride and tetrahydrofuran and slow evaporating solvents include monochlorobenzene. Generally, the solids concentration of the transport layer coating should be sufficient, under the coating application conditions selected, to facilitate the formation of a transport layer coating which resists flow prior to the application of the overcoating coating layer. The expression "solids" employed herein is defined as nonsolvent materials such as the charge transport material, film forming binder, surfactants and stabilizing additives.

Any suitable and conventional technique may be utilized to mix and thereafter apply the charge transport layer coating mixture to the charge generating layer. Typical application techniques include spraying, dip coating, roll coating, wire wound rod coating, and the like.

For a vertical dip coated drum, no flow of charge transport layer coating should be noticeable to the naked eye at the time the drum carrying the applied transport layer overcoat layer coating is removed from the transport layer coating bath. Typically, at this point in time, substantially immediately after withdrawal from the charge transport layer coating bath, the undried charge transport layer coating contains at least about 30 percent by weight of the solvent, based on the total weight of the undried charge transport layer coating. An undried charge transport layer coating can contain up to about 50 percent by weight of solvent, based on the total weight of the wet charge transport layer coating, without flowing as a coating on a vertical surface. The solvent content can be higher, as much as 60 to 70 percent, for horizontal surfaces employed in web coating.

The deposited charge transport layer coating mixture remains undried up to the point in time when the overcoat layer coating is applied. The expression "undried" layer as employed herein is defined as a layer which contains at least about 30 percent by weight solvent, based on the total weight of the wet charge transport layer coating. The freshly applied liquid charge transport layer coating should be continuous and sufficiently thick to provide the desired predetermined dried layer thicknesses. Normally, due to solvent vaporization during application of the charge transport layer, the relatively thick undried charge transport layer coating is tacky immediately prior to the application of the overcoating layer. The percent of solvent in the charge transport layer, at the time the overcoating layer is applied, depends upon the solvent, ambient temperature and coating technique employed. Thus, an undried charge transport layer coating is formed by applying to the charge generating layer a solution comprising a charge transport molecule, a first film forming binder and at least a first solvent with either or both a solution comprising a charge transporting polymer and at least a first solvent.

In general, the ratio of the thickness of the hole transport layer to the charge generator layers after drying is preferably maintained from about 2:1 to 200:1 and in some instances as great as 400:1. More preferably, the thickness of the charge transport layer after drying is between about 10 and about 50 micrometers, but thicknesses outside this range can also be used. The charge transport layer after drying optimally has an average thickness from about 12 micrometers to about 35 micrometers. The hole transport layer after drying should be an insulator to the extent that the electrostatic charge placed on the hole transport layer is not conducted in the absence of illumination at a rate sufficient to prevent formation and retention of an electrostatic latent image thereon. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

A wet overcoat layer coating is formed by applying to the undried charge transport layer coating an overcoat layer coating solution comprising a second film forming polymer and at least a second solvent, the charge transport molecule and first film forming polymer with either or in combination with a charge transporting polymer in the charge transport layer being substantially insoluble in the second solvent and the second polymer being substantially insoluble in the first solvent used to dissolve the first film forming polymer or charge transporting polymer.

Any suitable solvent soluble film forming polymer may be utilized in the overcoat layer. The solvent soluble film forming polymer may be a thermoplastic polymer, a prepolymer or a cross linkable polymer. Typical solvent soluble film forming thermoplastic polymers include, for example, polyamides (e.g., Elvamide 8023, Elvamide 8063, Elvamide 8066, Elvamide 8061, and the like all available from E. I. DuPont de Nemours), phenoxy resins (e.g., PKHH, PKHW44, PKHC, PKHH, PKHJ, PKFE and the like all available from Paphen, InChem Corporation), and the like. Typical prepolymers include, for example, epoxy resins (e.g., Epon 828, Epon 1001, Epon 1002, Epon 1004, Epon 1009 and the like, all available from Shell Chemical), urethane prepolymers, melamine-formadehyde, and the like. The expression "prepolymer" as employed herein is defined as a polymer which increases in molecular weight or crosslinks on heating. Typical solvent soluble film forming cross linkable polymers include, for example, hydrbxymethylpolyamides, methoxymethylpolyamides, Luckamide (DaiNippon), phenoxy resins, epoxy resins, melamine-formaldehyde_resins, urea-formaldehyde resins, and the like. The film forming polymer selected for the overcoat layer should be insoluble in the solvent employed to apply the charge transport layer. The solvent soluble film forming polymer for the overcoat layer may be a thermoplastic polymer, prepolymer or a cross linkable polymer which forms, at a predetermined elevated temperature, a migration barrier against solvents used for the charge transport layer. A solvent soluble cross linkable polymer becomes solvent insoluble and a barrier to solvent migration after the polymer is cross linked. The undried overcoat layer allows the solvent from the charge transport layer coating to migrate through the undried overcoat layer coating. If desired, a temperature triggered catalyst for a cross linkable film forming polymer or a temperature triggered catalyst for polymerizing a prepolymer may be employed in the overcoat layer coating.

Any suitable solvent which evaporates at a temperature below temperatures which adversely affect the physical and electrical properties of the photoreceptor may be utilized for the overcoat layer coating. The solvent utilized should dissolve the film forming binder of the overcoat layer and not dissolve the film forming polymer of the charge transport layer. Preferably, the solvent for applying the overcoat layer is immiscible with the solvent utilized to apply the charge transport layer. Failure to meet these requirements will result in photoreceptors with intermixing of the transport layer and overcoat layer region in the device which may exhibit undesirable electrical properties such as cycle-up caused by charge trapping. Also, in drum production, cross contamination of the overcoat solution in a dip coating vessel can occur from charge transport layer leaching. The relative proportions of solids to solvent utilized in the overcoat layer coating mixtures depends upon the coating technique utilized. Thus, the ratios can be different depending upon the coating technique selected. The overcoating layer coating solution preferably contains between about 10 to about 40 percent solids and between about 90 to 60 percent solvent. The solvent used depends on the polymer selected and includes, for example, methanol, HB (close to the evaporation rate of monochlorobenzene), 1-propanol, Dowanol®D [1-methoxy-2-propanol], tetrahydrofuran, and the like. In drying, typical boiling points for the different solvents that may be employed include, for example, methanol at 55° C., tetrahydrofuran (THF) at 66° C., 1-methoxy-2-propanol at 119° C., monochlorobenzene (MCB) at 133° C. and methylene chloride at 42° C. In dipcoating, higher boiling [lower volitility] solvents are preferred because excessive loss of solvent due to evaporation can make maintenance of appropriate solution viscosities difficult.

The components of the overcoating layer may be mixed together by any suitable conventional means. Typical mixing means include stirring rods, ultrasonic vibrators, magnetic stirrers, paint shakers, sand mills, roll pebble mills, sonic mixers, melt mixing devices and the like. As indicated above, all the film forming polymer components of the overcoat layer are solvent soluble.

Any suitable coating process may be employed to apply the overcoat layer coating. Typical coating techniques include, for example, dip coating, spray coating, extrusion coating, draw bar coating, dip coating, gravure coating, silk screening, air knife coating, reverse roll coating, extrusion coating, wire wound rod coating, and the like.

Preferred overcoat film forming polymers include cross linkable inert film forming alcohol soluble polyamide polymers. Any suitable cross linkable hole insulating film forming alcohol soluble polyamide polymer may be employed in the overcoating of this invention. Amongst all polyamides there are two classes: a first class of alcohol polyamides containing methoxymethyl groups and a second class of polyamides other alcohol soluble polyamides free of methoxymethyl groups. Any suitable formaldehyde generating cross linking agent, alkoxylated cross linking agent, methylolamine cross linking agent or mixtures thereof may be utilized for enhancing cross linking of the first class of alcohol soluble polyamides containing methoxymethyl groups. Typical formaldehyde generating materials include, for example, trioxane, 1,3-dioxolane, dimethoxymethane, hydroxymethyl substituted melamines, formalin, and the like. The expression "formaldehyde generating material" as employed herein is defined as a source of latent formaldehyde or methylene dioxy or hydroxy methyl ether groups.

Typical alkoxylated cross linking agents are alkoxylated include, for example, hexamethoxymethyl melamine (e.g. Cymel 303), dimethoxymethane (methylal), methoxymethyl melamine, butyl etherified melamine resins, methyl etherified melamine resins, methyl-butyl etherified melamine resins and methyl-isobutyl etherified melamine resins and the like. The expression "alkoxylated cross linking agents" as employed herein is defined as cross linking agents with alkoxyalkyl functional groups. An alkoxyalkyl groups may be represented by ROR'— wherein R is an alkyl group containing from 1 to 4 carbon atoms and R' is an alkylene or isoalkylene group containing from 1 to 4 carbon atoms. A preferred alkoxylated cross linking agent is hexamethoxymethyl melamine represented by the formula:

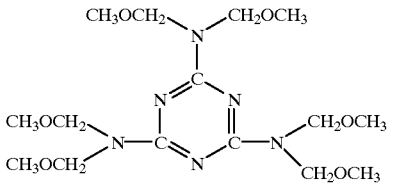

The expression "methylolamine cross linking agents" as employed herein is defined as cross linking agents with >N—$CH_2OH$ functional groups. Typical methylolamine cross linking agents include, for example, trimethylolmelamine, hexamethylolmelamine, and the like. Methylolamine cross linking agents may be prepared, for example, by mixing melamine and formaldehyde in a reaction vessel in the proper ratios under the correct conditions to form a methylol melamine which contains —N—$CH_2OH$ groups. A typical methylolamine is hexamethylolmelamine represented by the following structure:

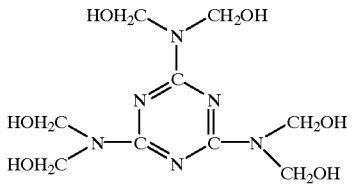

These methylol products can be alkoxylated to form alkoxylated melamines [e.g., methoxylmethylmelamine]. Thus, condensation products of melamine and formaldehyde are precursors for methoxymethylated materials. Hexamethylolmelamine will function in a similar cross-linking manner as hexamethoxymethylmelamine.

Alkoxylated cross linking agents and methylolamine cross linking agents are commercially available. Typical commercially available cross linking agents include, for example, amine derivatives such as hexamethoxymethyl melamine, and/or condensation products of an amine, e.g. melamine, diazine, urea, cyclic ethylene urea, cyclic propylene urea, thiourea, cyclic ethylene thiourea, aziridines, alkyl melamines, aryl melamines, benzo guanamines, guanamines, alkyl guanamines and aryl guanamines, with an aldehyde, e.g. formaldehyde. A preferred cross-linking agent is the condensation product of melamine with formaldehyde. The condensation product may optionally be alkoxylated. The weight average molecular weight of the cross-linking agent is preferably less than 2000, more preferably less than 1500, and particularly in the range from 250 to 500. Commercially available cross linking agents include, for example, CYMEL 1168, CYMEL 1161, and CYMEL 1158 (available from CYTEC Industries, Inc., Five Garret Mountain Plaza, West Paterson, N.J. 07424); RESIMENE 755 and RESIMENE 4514 (available from Monsanto Chemical Co.); butyl etherified melamine resins (butoxymethylmelamine resins) such as U-VAN 20SE-60 and U-VAN 225 (available from Mitsui Toatsu Chemicals Inc.) and SUPERBECKAMINE G840 and SUPERBECKAMINE G821 (available from Dainippon Ink & Chemicals, Inc.); methyl etherified melamine resins (methoxymethyl melamine resins) such as CYMEL 303, CYMEL 325, CYMEL 327, CYMEL 350 and CYMEL 370 (available form Mitsui Cyanamide Co., Ltd.), NIKARAK MS17 and NIKARAK MS15 (available from Sanwa Chemicals Co., Ltd.), Resimene 741 (available from Monsanto Chemical Co., Ltd.) and SUMIMAL M-100, SUMIMAL M-40S and SUMIMAL M55 (available from Sumitomo Chemical Co., Ltd.); methyl-butyl etherified melamine resins (methoxy/butoxy methylmelamines) such as CYMEL 235, CYMEL 202, CYMEL 238, CYMEL 254, CYMEL 272 and CYMEL 1130 (available from Mitsui Cyanamide Co., Ltd.) and SUMIMAL M66B (available from Sumitomo Chemical Co., Ltd.); and methyl-isobutyl etherified melamine resins (methoxy/isobutoxy melamine resins). such as CYMEL XV 805 (available from Mitsui Cyanamide Co., Ltd.) and NIKARAK MS 95 (available from Sanwa Chemical Co., Ltd.). Still other alkoxylated melamine resins such as methylated melamine resins include CYMEL 300, CYMEL 301 and CYMEL 350 (available from American Cyanamid Company).

The formaldehyde generating material such as trioxane in the coating composition serves to cross link the crosslinkable alcohol soluble polyamide containing methoxy methyl groups attached to amide nitrogen atoms. Preferably the coating composition comprises between about 5 percent by weight and about 10 percent by weight trioxane based on the total weight of the crosslinkable alcohol soluble polyamide containing methoxy methyl groups attached to amide nitrogen atoms. The combination of oxalic acid and trioxane facilitates cross linking of the polyamide at lower temperatures. Although all polyamides are alcohol soluble, all polyamides are normally not cross linkable. However, with special materials such as alkoxylated cross linking agents (e.g., Cymel 303) or methylolamine cross linking agents, all polyamides can be cross linkable.

A preferred methoxymethyl generating material is hexamethoxymethylmelamine which serves as a cross linking agent for the polyamide. Hexamethoxymethylmelamine may be represented by the following structure:

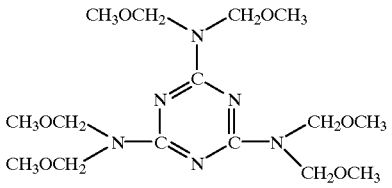

Hexamethoxymethylmelamine is available commercially, for example, Cymel 303, from CYTEC Industries Inc., W. Patterson, N.J. Preferably the coating composition comprises between about 1 percent by weight and about 50 percent by weight hexamethoxymethylmelamine based on the total weight of polyamide. When less than about 1 percent by weight hexamethoxymethylmelamine is used, the cross-linking efficiency is too low. When greater than about 50 percent by weight hexamethoxymethylmelamine is used, the resulting films highly plasticized.

For the second class of alcohol soluble polyamides free of methoxymethyl groups, a methoxymethyl generating material can be used to enhance the cross-linking. Any suitable methoxymethyl generating material may be utilized for enhancing cross linking of the second class of alcohol soluble polyamides free methoxymethyl groups. Typical methoxymethyl generating material include the same methoxymethyl generating materials described above with reference to enhance cross-linking of first class of alcohol soluble polyamides containing methoxymethyl groups.

A preferred polyamide for the first solution comprises a cross linkable alcohol soluble polyamide polymers having methoxy methyl groups attached to the nitrogen atoms of amide groups in the polymer backbone prior to cross linking is selected from the group consisting of materials represented by the following formulae I and II:

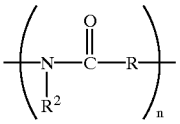

wherein:

n is a positive integer,

R is independently selected from the group consisting of alkylene, arylene or alkarylene units, between 1 and 100 percent of the $R^2$ sites are —H, and the remainder of the $R^2$ sites are —$CH_2$—O—$CH_3$and

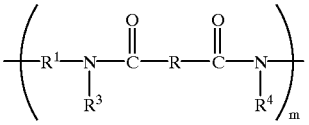

wherein:

m is a positive integer, $R^1$ and R are independently selected from the group consisting of alkylene, arylene or alkarylene units, between 1 and 100 percent of the $R^3$ and $R^4$ sites are —H, and the remainder of the $R^3$ and $R^4$ sites are —$CH_2$—O—$CH_3$.

In the above formula, the methoxy groups participate in cross linking while the added sources of formaldehyde accelerate the cross-linking rate and the sources of methoxymethyl groups (e.g., Cymels) cross-link the polyamide chains further by reacting with the unsubstituted —N—H groups. In the presence of acids and elevated temperatures, these methoxy methyl groups in the first class of polyamides containing methoxy methyl groups attached to amide nitrogen atoms are hydrolyzed to (methylol groups) which decompose to form cross linked polymer chains and methanol byproduct. The addition of a cross linking agent selected from the group comprising a formaldehyde generating cross linking agent, an alkoxylated cross linking agent, a methylolamine cross linking agent and mixtures thereof accelerate the cross-linking rates. These polyamides should form solid films if dried prior to cross linking. The polyamide should also be soluble, prior to cross-linking, in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to cross linking include, for example, hole insulating alcohol soluble polyamide film forming polymers include, for example, Luckamide 5003 from Dai Nippon Ink, Nylon 6 with methylmethoxy pendant groups, CM4OOO from Toray Industries, Ltd. and CM8OOO from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone.

A preferred polyamide for the second solution comprises a crosslinkable alcohol soluble polyamide free of methoxy methyl groups attached to amide nitrogen atoms prior to cross linking is represented by the following formulae I and II:

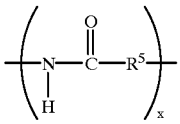

wherein:

x is a positive integer, $R^5$ is independently selected from the group consisting of alkylene, arylene or alkarylene units, and,

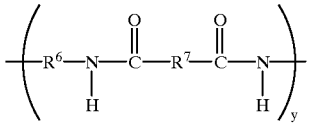

wherein:

y is a positive integer, and $R^6$ and $R^7$ are independently selected from the group consisting of alkylene, arylene or alkarylene units.

Typical alcohol soluble polyamide polymers free of methoxy methyl groups attached to the nitrogen atoms of amide groups in the polymer backbone prior to cross linking include, for example, Elvamides from DuPont de Nemours & Co., and the like. These polyamides should form solid films if dried prior to crosslinking. These polyamides can be alcohol soluble, for example, with polar functional groups, such as methoxy, ethoxy and hydroxy groups, pendant from the polymer backbone. By the addition of an alkoxylated cross linking agent, a methylolamine cross linking agent and mixtures thereof (e.g., Cymels) cross-linked polyamides can be obtained under suitable acidic conditions and thermal cures. Generally, the dried and cured overcoat comprises between about 30 percent by weight and about 70 percent by weight polyamide, based on the total weight of overcoat layer after drying and curing.

Since the film forming polyamides are also soluble in a solvent, they can be readily coated by conventional coating techniques. Typical solvents include, for example, butanol, methanol, butyl acetate, ethanol, cyclohexanone, tetrahydrofuran, methyl ethyl ketone, and the like and mixtures thereof. Typical diluents include, for example, 1,3 dioxolane, tetrahydrofuran, chlorobenzene, fluorobenzene, methylene chloride, and the like and mixtures thereof.

Generally, sufficient cross linking agent and catalyst [pH modifiers] should be added to the coating composition to achieve cross linking after drying of the charge transport layer coating is completed. Preferably, the cross linking agents and catalyst [at the appropriate pH], are temperature activated which effects cross linking after most of the solvent in the transport layer has migrated through the overcoat layer and the drying temperature has been elevated to the cross linking temperature. The combination of the cross linking material and catalyst brings about cross linking at an elevated temperature. Typical amounts of cross linking agent range from about 1 percent by weight and 30 percent by weight based on the weight of the polyamide.

Crosslinking is accomplished by heating in the presence of a catalyst. Any suitable catalyst may be employed. Typical catalysts include, for example, oxalic acid, p-toluenesulfonic acid, methanesulfonic acid, maleic acid, phosphoric acid, hexamic acid and the like and mixtures thereof. These acids have a $PK_a$ of less than about 3, and more preferably, between about 0 and about 3. Catalysts that transform into a gaseous product during the cross linking reaction are preferred because they escape the coating mixture and leave no residue that might adversely affect the electrical properties of the final overcoating. A typical gas forming catalyst is, for example, oxalic acid. The temperature used for cross linking varies with the specific catalyst and heating time utilized and the degree of cross linking desired. In general, acid or basic catalysts are used to crosslink the polymers by condensation (with loss of methanol) of methoxymethyl side groups at greater than 100° C. Epoxy resins are polymerized with various catalysts including amines, Cymel 303, anhydrides, and acids and bases, as well as phosphonium salts at temperatures between 25° C. and usually less than 150° C. Phenoxy resins crosslink with Cymel 303 in the presence of oxalic acid at about 110° C. Heating times vary between about 3 minutes to about 1 hour with about 30 minutes being preferred. Generally, the degree of cross linking selected depends upon the desired flexibility of the final photoreceptor. For example, complete cross linking may be used for rigid drum or plate photoreceptors. However, partial cross linking is preferred for flexible photoreceptors and the desired degree of cross linking will vary depending example, web or belt configurations. The degree of cross linking can be controlled by the relative amount of catalyst employed and the amount of specific polyamide, cross linking agent, catalyst, temperature and time used for the reaction. A typical cross linking temperature used for Luckamide with oxalic acid as a catalyst is about 125° C. for 30 minutes. After cross linking, the overcoating should be substantially insoluble in the solvent in which it was soluble prior to cross linking. Thus, no overcoating material will be removed when rubbed with a cloth soaked in the solvent. Cross linking results in the development of a three dimensional network which restrains the dihydroxy arylamine molecule as a fish is caught in a gill net. Prolonged attempts to extract the highly fluorescent dihydroxy arylamine hole transport molecule from the cross linked overcoat, using long exposure to branched hydrocarbon solvents, revealed that the transport molecule is completely immobilized. Thus, when UV light is used to examine the extractant or the applicator pad no fluorescence is observed. The molecule is also locked into the overcoat by hydrogen bonding to amide sites on the polyamide.

The overcoat also includes dihydroxy arylamine charge transport molecules. Preferably, the dihydroxy arylamine is represented by the following formula:

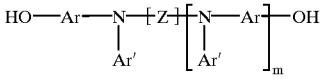

wherein m is 0 or 1,

Z is selected from the group consisting of:

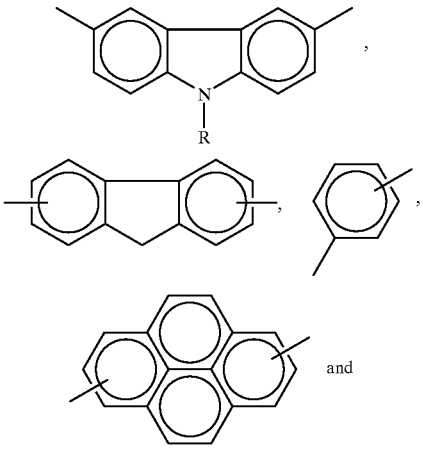

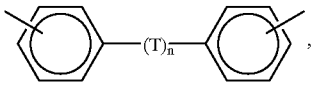

n is 0 or 1,

Ar is selected from the group consisting of:

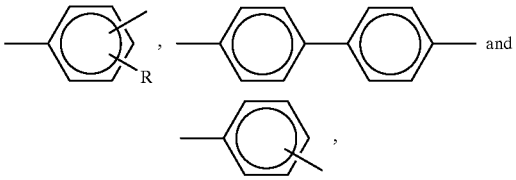

R is selected from the group consisting of $—CH_3$, $—C_2H_5$, $—C_3H_7$, and $—C_4H_9$, Ar' is selected from the group consisting of:

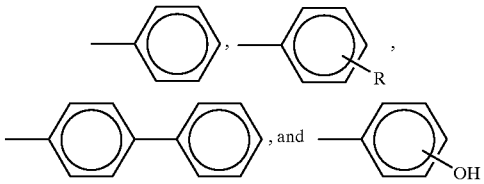

T is selected from the group consisting of:

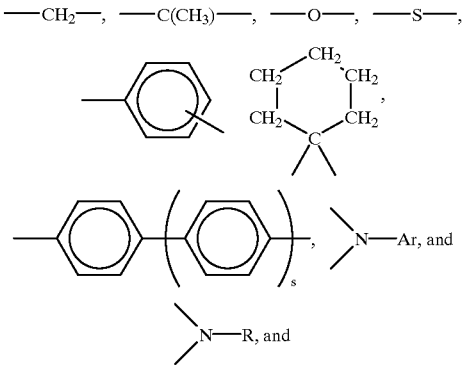

s is 0, 1 or 2.

This hydroxyarylamine compound is described in detail in U.S. Pat. No. 4,871,634, the entire disclosure thereof being incorporated herein by reference. Although, many conventional charge transporting materials will not dissolve in all polyamides, the cross linkable polyamides employed in the overcoat compositions of this invention contain hydroxy groups and are alcohol soluble along with the dihydroxy arylamine charge transporting material.

Generally, the hydroxy arylamine compounds are prepared, for example, by hydrolyzing an dialkoxy arylamine. A typical process for preparing alkoxy arylamines is disclosed in Example I of U.S. Pat. No. 4,588,666 to Stolka et al, the entire disclosure of this patent being incorporated herein by reference.

Typical hydroxy arylamine compounds useful for the overcoating composition of this invention include, for example:

N,N'-diphenyl-N,N'-bis(3-hydroxyphenyl)-[1,1'-biphenyl]-4,4'-diamine;

N,N,N',N',-tetra(3-hydroxyphenyl)-[1,1'-biphenyl]-4,4'-diamine;

N,N-di(3-hydroxyphenyl)-m-toluidine;

1,1-bis-[4-(di-N,N-m-hydroxpyphenyl)-aminophenyl]-cyclohexane;

1,1-bis[4-(N-m-hydroxyphenyl)-4-(N-phenyl)-aminophenyl]-cyclohexane;

bis-(N-(3-hydroxyphenyl)-N-phenyl-4-aminophenyl)-methane;

bis[(N-(3-hydroxyphenyl)-N-phenyl)-4-aminophenyl]-isopropylidene;

N,N'-diphenyl-N,N'-bis(3-hydroxyphenyl)-[1,1':4',1"-terphenyl]-4,4"-diamine;

9-ethyl-3,6-bis[N-phenyl-N-3(3-hydroxyphenyl)-amino]-carbazole;

2,7-bis[N,N-di(3-hydroxyphenyl)-amino]-fluorene;

1,6-bis[N,N-di(3-hydroxyphenyl)-amino]-pyrene;

1,4-bis[N-phenyl-N-(3-hydroxyphenyl)]-phenylenediamine.

The concentration of the hydroxy arylamine in the overcoat can be between about 2 percent and about 50 percent by weight based on the total weight of the dried and cured overcoat. Preferably, the concentration of the hydroxy arylamine in the overcoat layer is between about 10 percent by weight and about 50 percent by weight based on the total weight of the dried and cured overcoat layer. These concentrations are for the combination of both the charge transport molecules and the oxidized charge transport molecules in the dried and cured overcoat layer. When less than about 10 percent by weight of hydroxy arylamine is present in the overcoat, a residual voltage may develop with cycling resulting in background problems. Also a humidity dependence of conductivity might arise. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The oxalic acid in the coating composition serves to cross link the polyamide and oxidize the dihydroxy amine. The oxidation of the molecules makes the overcoat partially conducting. Carbon black, fluorinated carbon blacks (such as Accuflor available from Allied-Signal-Bendix), tin oxides, titanium oxides, quaternary ammonium salts, various phthalocyanines, and the cation radicals of various tertiary arylamines, and the like, can be added to produce partly conducting layers. The partly conducting layers can be inherently semi-conducting, field dependent conducting, charge injecting, and the like. Particles for partially conductive layers are also disclosed in U.S. Application Ser. No. 09/429,387 entitled IMAGING MEMBER WITH PARTIALLY CONDUCTIVE OVERCOATING, filed in the names of Fuller et al. concurrently herewith (Attorney Docket No. D99403), the entire disclosure of this application being incorporated herein by reference.

Preferably the polyamide coating composition comprises between about 6 percent by weight and about 15 percent by weight acid based on the total weight of polyamide, the acid having a $pK_a$ of less than about 3 and, more preferably, between about 0 and about 3. When less than about 6 percent by weight acid is used, the polyamide is not completely cross linked. When greater than about 15 percent by weight acid is used, the overcoat starts absorbing an undesirable amount of light from the exposure/erase (activating radiation) sources.

Generally, the soluble components of the overcoat coating mixture are mixed in a suitable solvent or mixture of solvents prior to the addition of the charge injecting particles. Any suitable solvent may be utilized. Preferably the solvent is methanol, ethanol, propanol, and the like and mixtures thereof. The solvent selected should not adversely affect the underlying photoreceptor. For example, the solvent selected should not dissolve or crystallize the underlying photoreceptor. The relative amount of solvent employed depends upon the specific materials and coating technique employed to fabricate the overcoat. Typical ranges of solids include, for example, between about 5 percent by weight to about 40 percent by weight soluble solids. Higher solids solutions are used for the charge transfer layers; whereas lower solids solutions are used for the overcoating solution. The overcoat layer is usually thinner because of reduced hole mobility in the more polar overcoat layer.

Any suitable drying system may be utilized to dry the combination of the undried charge transport layer coating and overcoat layer coating. Drying is accomplished by applying heat to both the undried charge transport layer coating and the wet overcoat layer coating to remove the solvent (e.g., first solvent) from the charge transport layer coating through the vercoat layer coating while maintaining the overcoat layer coating porous to migration of the first solvent through the overcoat layer coating until the charge transport layer is substantially dry. Thus, during the drying process, the overcoating layer must be maintained sufficiently permeable to penetration of solvent from the charge transport layer until sufficient solvent migrates from the charge transport layer through the overcoat layer to ultimately form a final photoreceptor after completion of all drying which retains an incremental residual voltage of less than about 20 volts. The incremental residual voltage is the increase in residual voltage over and above that of a device whose overcoat layer is coated after the transport layer is dried. The residual voltage is on the discharged, photoexposed device. Vo is 600 v to 800 v; Vr (after exposure)=ca 20 volts without overcoat and about 40 volts with an overcoat. The diffusion coefficient of the solvent may be maintained to accomplish this level within predetermined periods of time. The expression "diffusion coefficient ", as employed herein is defined as solvent permeability through the various layers. The amount of residual solvent in the charge transport layer after substantial completion of drying of the transport layer/overcoat layer combination depends upon the solvent used in the transport layer and solvent used in the overcoat layer. Generally, retention of an incremental residual voltage of less than about 20 volts is achieved when the overcoat layer remains permeable to solvent from the charge transport layer until the amount of solvent in the charge transport layer is reduced to less than about 8 percent by weight based on the total weight of the charge transport layer. Residual solvent can also adversely affect sensitivity of the final photoreceptor. Preferably, the residual amount of solvent remaining in the charge transport layer after drying is less than about 1 percent by weight based on the total weight of the charge transport layer prior to cross linking. Although both layers are ultimately dried, the overcoat is not crosslinked until the charge transport layer is dried. Generally, the overcoating is considered dry when the percent of original solvent remaining in the overcoating layer remains substantially unchanged (no further weight lost) during the drying process.

Generally, when a cross linkable film forming polymer is employed in the overcoating layer, it should not be fully cross linked prior to substantial completion of drying of the charge transport layer. Thus, for cross linkable polymers in the overcoat layer coating, the polymer is maintained soluble in the overcoat solvent until the charge transport layer is substantially dry. For overcoat layer coating solutions of thermoplastic film forming polymers, the percent of original solvent in the overcoating is maintained above about 50 weight percent by weight based on the weight of the original overcoat solvent.

Heat is applied to both the undried charge transport layer coating and the wet overcoat layer coating to migrate the first solvent from the charge transport layer coating through the overcoat layer coating while the overcoat layer coating is maintained porous to migration of the first solvent through the overcoat layer coating until the charge transport layer is substantially dry. About the time the charge transport layer is substantially dry, heat energy applied to the overcoat layer coating is sufficiently increased to substantially reduce or eliminate porosity to the first solvent and to form a substantially dry overcoat layer. The temperature during drying may be increased in any suitable manner. Temperature increase by ramping of the temperature; by using a step-wise increase; or by a combination of ramping and step-wise increase are preferred to shorten the time for drying. Generally, the maintaining of a constant relatively low drying temperature will eventually dry the material, but may take an unreasonable amount of time. Temperature elevation during drying should be sufficient to drive the solvent out of the charge transport layer before the overcoating layer becomes a barrier to solvent diffusion therethrough. If a cross linkable polymer is used in the overcoat layer, the temperature of the air adjacent to (or impinging on) the coated drum should be maintained below the cross linking temperature of the polymer in the overcoat layer and should be maintained low enough to avoid blistering of the charge transport layer and the overcoating layer. Blistering will of course depend upon the specific solvent and film forming polymer utilized.

Determination of the slope of the ramped temperature increase will depend upon the specific solvent and drying temperatures utilized. The slope can be readily determined by plotting the rate of solvent removal from the charge transport layer against oven temperature. Preferably, the drying times are between about 15 minutes and about 45 minutes. The residual solvent in the charge transport layer is preferably less than about 8 percent by weight based on the total weight of the charge transport in less than one hour of drying time. Moreover, the solvent in the charge transport layer should be substantially removed prior to substantial removal of the solvent from the overcoat layer.

Any suitable drying system may be utilized for drying the coatings. A forced air oven is preferred because of rapid drying and safety concerns [lower solvent concentrations achieved]. Preferably, drying is effected by impingement of air streams directed against the exposed surface of the overcoating layer. Optimum results are achieved when the paths of the air streams are substantially perpendicular to the coated surface. For drums, the air stream paths are perpendicular to an imaginary tangent to the curved surface of the drum and perpendicular to the imaginary axis of the drum. Preferably, the air streams have a velocity of between about 1 cm per second and about 100 cm per second. The air stream velocity should be maintained at a velocity below that which would distort the deposited undried charge transport layer coating and undried overcoat layer coating. Preferably, the drying of the combination of undried transport layer coating and undried overcoat layer coating is a ramped function in which the final temperature of drying is typically arrived at, for example, after about 25 minutes. Alternatively, drying can be accomplished in multiple steps such as, for example, a lower temperature (e.g., between about 80° C. and about 90° C. for about 25 minutes) followed by a final temperature (e.g., between about 110° C. and about 120° C. for 30 minutes). This allows that the transport layer solvent (e.g., monochlorobenzene) to escape before the overcoat layer dries or cross links to form a barrier to solvent migration from the charge transport layer. When a cross linkable polyamide is employed in the overcoat layer, the polyamide cross links and is insoluble in alcohol by about the time drying and curing is completed. Such cross linked polymer is a barrier to solvent migration from the transport layer. Preferably, the overcoat layer after drying has a thickness between about 1 micrometers and about 8 micrometers.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The process of this invention applies overcoat layer coatings on undried charge transport layer coatings. These overcoat layer coatings on undried charge transport layer coatings are dried in a single drying process thereby eliminating a separate drying process for the charge transport layer coating.

PREFERRED EMBODIMENTS OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Several electrophotographic imaging members were prepared by applying by dip coating a charge blocking layer onto the rough surface of eight aluminum drums having a diameter of 4 cm and a length of 31 cm. The blocking layer coating mixture was a solution of 8 weight percent polyamide (nylon 6) dissolved in 92 weight percent butanol, methanol and water solvent mixture. The butanol, methanol and water mixture percentages were 55, 36 and 9 percent by weight, respectively. The coating was applied at a coating bath withdrawal rate of 300 millimeters/minute. After drying in a forced air oven, the blocking layers had thicknesses of 1.5 micrometers. The dried blocking layers were coated with a charge generating layer containing 54 weight percent chloro gallium phthalocyanine pigment particles, 46 weight percent VMCH film forming polymer and employing xylene and n-butyl acetate solvents. 1.67 grams of VMCH was first dissolved in 8.8 grams of n-butyl acetate and 17.6 grams of xylene. After complete dissolution, 2 grams of chloro gallium phthalocyanine pigment particles were added and was ball milled. It was then diluted with 6 grams of 2:1 mixture of xylene/n-butyl acetate. The coatings were applied at a coating bath withdrawal rate of 300 millimeters/minute. After drying in a forced air oven, the charge generating layers had thicknesses of 0.2 micrometer. A charge transport layer coating solution was prepared containing 40 grams of N,N'-diphenyl-N,N'-bis(3-methylphenyl)-[1,1'-biphenyl]-4,4'-diamine and 60 grams of poly(4,4'-diphenyl-1,1'-cyclohexane carbonate) (PCZ 400 available from Mitsubishi Chemical Co.) dissolved in a solvent mixture consisting of 80 grams of monochlorobenzene and 320 grams of tetrahydrofuran. The charge transport coating solution was applied onto the coated drum by dipping the drum into the charge transport coating solution and withdrawing at a rate of 150 centimeters per second. The drying step is described in Example III

EXAMPLE II

Polyamide containing methoxymethyl groups (Luckamide 5003 available from Dai Nippon Ink) [4 grams], methanol [10 grams] and 1-propanol [10 grams] were combined in an 8 ounce amber bottle and warmed with magnetic stirring in a water bath at about 60° C. A solution formed within 30 minutes which was then allowed to cool to 25° C. and N,N'-diphenyl-N,N'-bis(3-hydroxyphenyl)-[1,1'-biphenyl]-4,4'-diamine (DHTBD) [3.6 grams] was added and stirred until a complete solution was formed. Steel shot [500 grams] and Black Pearls carbon [0.25 grams] were added to the polymer solution and milled for 48 hours. The milled solution passed through a Nitex filter [24 micrometers] to capture the steel shot and any large particulates. Oxalic acid [0.4 gram] was added and the mixture was warmed to 40° C. −50° C. until a solution formed. The solution was allowed to set overnight to insure mature viscosity properties. Overcoat layers [4 micrometers thick] were coated on three of the photoconductor drum photoreceptors of Example I using a Tsugiage ring coater. The drying step is described in Example III.

EXAMPLE III

Three drums were processed: (a) a control drum of Example I without the overcoat layer of Example II was dried at 118° C. for 30 minutes to form a 20 micrometer thick charge transport layer; (b) a second drum of Example I without the overcoat layer of Example II was not dried (undried) in an oven after forming the transport layer coating; (c) a third drum of Example I (without drying the transport layer) was coated with an overcoat layer of Example 2 and thereafter dried at 118° C. for 30 minutes. Drums III(a), III(b) and III(c) were checked for their sensitivities as described in Example IV.

EXAMPLE IV

Drum photoreceptors of Example III(a), III(b) and III(c) were first tested for xerographic sensitivity and cyclic stability. Each photoreceptor device was mounted on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptor on the drum was exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of a known intensity. The photoreceptor was erased by light source located at a position upstream of charging. The measurements made included charging of the photoreceptor in a constant current or voltage mode. The photoreceptor was corona charged to a negative polarity. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics (PIDC) were obtained by plotting the potentials at voltage probes 2 and 3 as a function of light exposure. The charge acceptance and dark decay were also measured in the scanner. The PIDC were measured with an initial potential of 500 Volts and then discharged. The control drum of Example III(a) had a image potential of 30 Volts at an exposure of 10 Ergs/cm$^2$, the device of Example III(b) that was not dried after the transport layer coating had an image potential of 190 Volts at an exposure of 10 Ergs/cm$^2$ and the third device of Example III(c) whose undried transport layer was overcoated with an overcoat layer and then dried had an image potential of 110 Volts at an exposure of 10 Ergs/cm$^2$.

EXAMPLE V

The three drums of Example III [III(a), III(b) and III(c)] were analyzed for residual solvent content in the transport layer. The residual solvents of methylene chloride ($CH_2Cl_2$), tetrahydrofuran (THF) and monochlorobenzene (MCB) were measured in units of micrograms/cm$^2$ of the transport layer film and the results are shown in Table 1. In the table, TL and OC are abreviations for transport layer and overcoat layer, respectively. The traditional one step drying of transport layer/overcoat combination resulted in a high concentration of monochlorobenzene in the transport layer (and, perhaps, in the generator layer) and resulted in a loss of sensitivity and change in the shape of the PIDC described in Example IV.

TABLE 1

| DEVICE | DRYING CONDITIONS | $CH_2Cl_2$ | THF | MCB |
|---|---|---|---|---|
| III(a) | TL dried at 118° C./30 min | <0.1 | <0.1 | <0.1 |
| III(b) | TL undried | <0.1 | 38 | >700 |
| III(c) | (TL + OC) dried at 118° C./30 min | <0.1 | 10 | 410 |

EXAMPLE VI

Three more drums of Example I without drying the transport layers were coated with overcoat layers of Example II to form three drum devices, VI(a), VI(b) an VI(c): a) the first device was dried first at 75° C. for 30 minutes followed by a drying step of 118° C. for 30 minutes, (b) the second device was dried first at 85° C. for 30 minutes followed by a drying step of 118° C. for 30 minutes, (c) the third device was dried first at 100° C. for 30 minutes followed by a drying step of 118° C. for 30 minutes. The PIDC of these devices were measured and the results described in Example VII and the residual solvents were measured and described in Example VIII.

EXAMPLE VII

The PIDCs of drums of Examples VI(a), VI(b) an VI(c) were measured on a scanner described in Example IV. The devices were charged to an initial potential of 500 Volts and then discharged. The drum of Example VI(a) had a image potential of 40 Volts at an exposure of 10 Ergs/cm$^2$, the device of Example VI(b) had an image potential of 45 Volts at an exposure of 10 Ergs/cm$^2$ and the third device of Example VI(c) had an image potential of 40 Volts at an exposure of 10 Ergs/cm$^2$. The incremental residual potential is less than 15 volts as compared to the control drum of example III (a).

EXAMPLE VIII

The drums of Example VI were analyzed for residual solvent content in the transport layer. The residual solvents of methylene chloride, tetrahydrofuran and monochlorobenzene were measured in units of micrograms/cm$^2$ of the transport layer film and are shown in Table 2. The residual MCB is considerably reduced as compared to drum of Example III(c) dried in the traditional one step process.

TABLE 2

| DEVICE | DRYING CONDITIONS | $CH_2Cl_2$ | THF | MCB |
|---|---|---|---|---|
| VI(a) | TL/OC dried at 75° C./30 min & 118° C./30 min | <0.1 | <0.1 | 16 |
| VI(b) | TL/OC dried at 85° C./30 min & 118° C./30 min | <0.1 | <0.1 | 15 |
| VI(c) | TL/OC dried at 100° C./30 min & 118° C./30 min | <0.1 | <0.1 | 19 |

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for fabricating an electrophotographic imaging member comprising forming a charge generating layer, forming an undried charge transport layer coating by applying to the charge generating layer a solution selected from either or both the group consisting of a solution comprising a charge transport molecule, a first film forming binder and at least a first solvent and a solution comprising a charge transporting polymer and at least a first solvent, forming an undried overcoat layer coating by applying to the undried charge transport layer coating an overcoat layer coating solution comprising a second film forming polymer and at least a second solvent, the charge transport molecule and first film forming polymer with either or both a charge transporting polymer being substantially insoluble in the second solvent and the second polymer being substantially insoluble in the first solvent, applying heat to both the undried charge transport layer coating and the undried overcoat layer coating to migrate the first solvent from the charge transport layer coating through the undried overcoat layer coating while maintaining the overcoat layer coating porous to migration of the first solvent through the overcoat layer coating until the charge transport layer is substantially dry, increasing the heat applied to the overcoat layer coating to form a substantially dry overcoat layer.

2. A process according to claim 1 wherein the second film forming polymer is a cross linkable film forming polymer.

3. A process according to claim 2 wherein the increasing of the heat applied to the overcoat layer coating cross links the cross linkable film forming polymer.

4. A process according to claim 3 wherein the increasing of the heat applied to the overcoat layer coating activates a cross linking catalyst which cross links the cross linkable film forming polymer.

5. A process according to claim 1 wherein the undried charge transport layer coating comprises between about 30 percent and about 50 percent by weight of the first solvent based on the total weight of the undried charge transport layer coating when the undried overcoat layer coating is applied to the undried charge transport layer coating.

6. A process according to claim 1 wherein the substantially dry overcoat layer is substantially impervious to migration of the first solvent through the wet overcoat layer coating.

7. A process according to claim 1 including terminating application of heat to the overcoat layer when the amount of the second solvent in the overcoat layer attains a level that remains substantially unchanged during continued application of heat.

8. A process according to claim 1 wherein the substantially dry charge transport layer comprises less than about 8 percent by weight of the first solvent, based on the total weight of the substantially dry charge transport layer.

9. A process according to claim 1 wherein the substantially dry charge transport layer comprises less than about 1 percent by weight of the first solvent, based on the total weight of the substantially dry charge transport layer.

10. A process according to claim 1 including maintaining the second film forming polymer soluble in the second solvent during the applying of heat to both the wet charge transport layer coating and the wet overcoat layer coating to migrate the first solvent from the wet charge transport layer coating through the wet overcoat layer coating.

11. A process according to claim 1 wherein the applying of heat to both the wet charge transport layer coating and the wet overcoat layer coating to migrate the first solvent from the wet charge transport layer coating through the wet overcoat layer coating comprises heating the wet charge transport layer coating and the wet overcoat layer coating in an oven.

12. A process according to claim 11 wherein the applying of heat includes incremental increases in oven temperature.

13. A process according to claim 11 wherein the applying of heat includes ramping of oven temperature.

14. A process according to claim 1 wherein the increasing of the heat applied to the wet overcoat layer coating to form a substantially dry overcoat layer comprises heating the charge transport layer coating and overcoat layer coating in an oven.

15. A process according to claim 14 wherein the increasing of the heat applied to the wet overcoat layer coating includes incremental increases in oven temperature.

16. A process according to claim 14 wherein the increasing of the heat applied to the wet overcoat layer coating includes ramping of oven temperature.

17. A process according to claim 1 including applying the heat to both the wet charge transport layer coating and the wet overcoat layer coating to migrate the first solvent from the wet charge transport layer coating through the wet overcoat layer coating at a temperature below a temperature which forms blisters in the wet charge transport layer coating and the wet overcoat layer coating.

18. A process according to claim 1 including applying the heat to both the wet charge transport layer coating and the wet overcoat layer coating with heated air streams directed at the wet overcoat layer.

19. A process according to claim 1 wherein the second solvent is immiscible in the first polymer layer to prevent mixing of the overcoat layer with the first polymer layer.

* * * * *